United States Patent [19]

Dahlgren

[11] 3,937,141

[45] Feb. 10, 1976

[54] DAMPENER FOR LITHOGRAPHIC PRINTING PLATES

[76] Inventor: Harold P. Dahlgren, 726 Regal Row, Dallas, Tex. 75247

[22] Filed: June 17, 1974

[21] Appl. No.: 480,080

[52] U.S. Cl. ..... 101/148

[51] Int. Cl.[2] ..... B41L 25/02; B41F 7/26

[58] Field of Search ..... 101/148, 350, 363, 364

[56] References Cited

UNITED STATES PATENTS

| | | | |
|---|---|---|---|
| 3,026,795 | 3/1962 | Dietrich | 101/148 |
| 3,106,154 | 10/1963 | Saul | 101/148 |
| 3,168,037 | 2/1965 | Dahlgen | 101/148 |
| 3,259,062 | 7/1966 | Dahlgren | 101/148 |
| 3,343,484 | 9/1967 | Dahlgren | 101/350 X |
| 3,433,155 | 3/1969 | Norton | 101/148 |
| 3,508,489 | 4/1970 | Norton | 101/148 |
| 3,587,460 | 6/1971 | Chambon | 101/148 |
| 3,647,525 | 3/1972 | Dahlgren | 101/148 X |
| 3,749,011 | 7/1973 | Abendroth et al. | 101/148 |

FOREIGN PATENTS OR APPLICATIONS

| | | | |
|---|---|---|---|
| 870,687 | 6/1961 | United Kingdom | 101/148 |

*Primary Examiner*—J. Reed Fisher

*Attorney, Agent, or Firm*—Howard E. Moore; Gerald G. Crutsinger

[57] ABSTRACT

A method and apparatus for delivering a controlled quantity of dampening fluid to a lithographic printing system comprising a smoothly finished transfer roller having a hydrophilic surface mounted in pressure indented relation with a metering roller having a smooth resilient surface. Pressure between the metering roller and transfer roller is adjustable to control the thickness of a film of dampening fluid metered therebetween onto the surface of the transfer roller. The film of dampening fluid is urged at controlled pressure into engagement with a film of ink on a roller in the printing system forming an interface between the films. Force is transmitted through the interface to rotate the transfer roller at a surface speed to maintain predetermined proportions of ink and dampening fluid on the roller surface.

10 Claims, 3 Drawing Figures

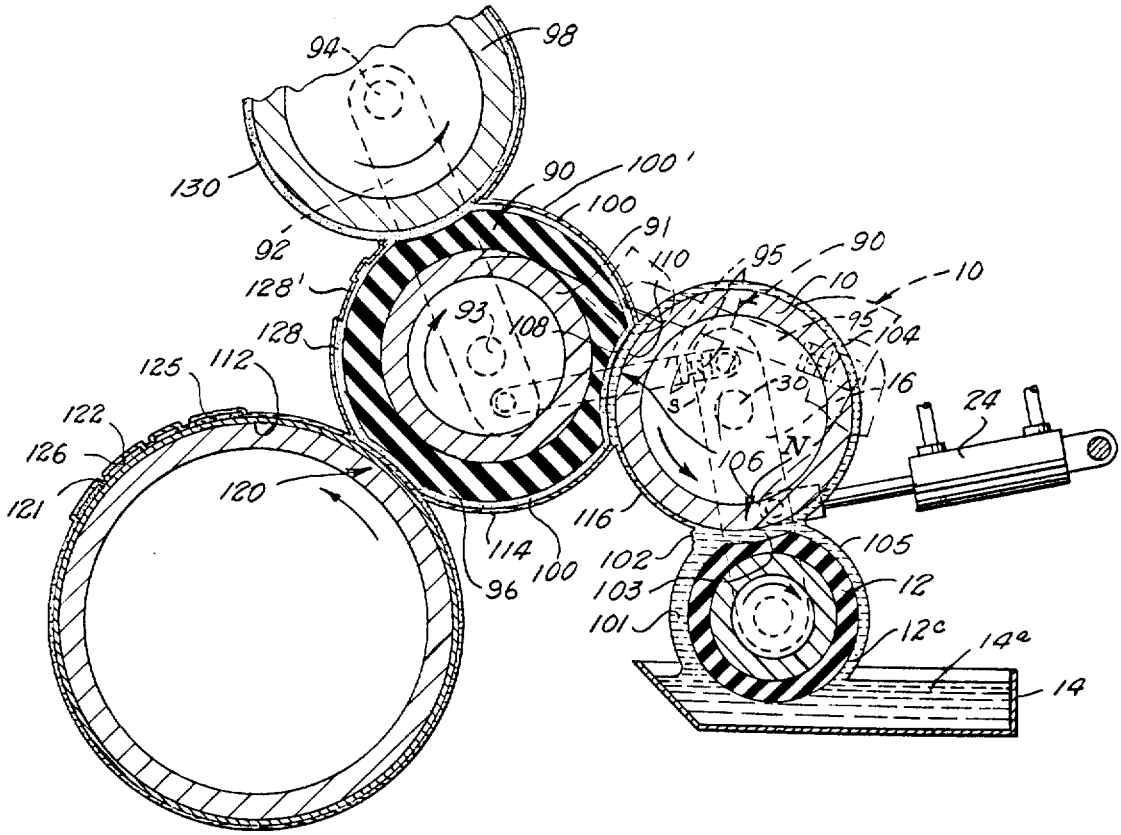
Fig. II
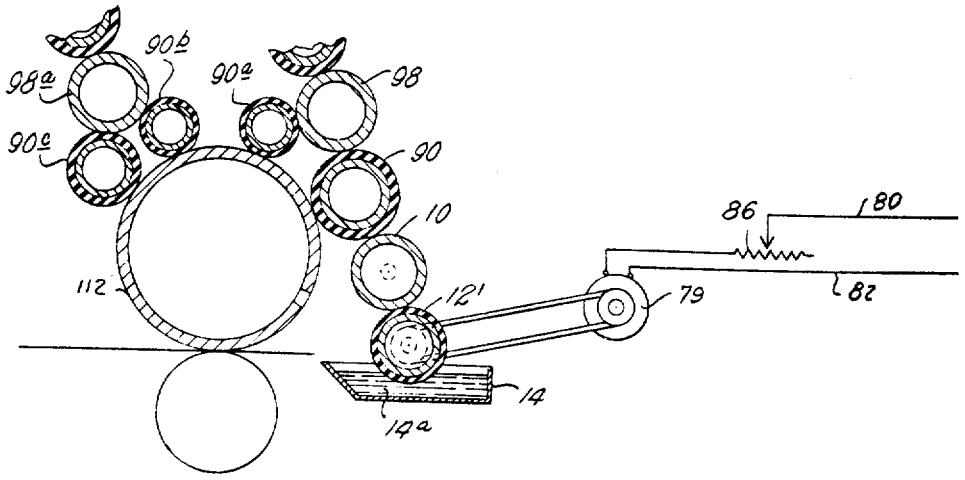
Fig. III

DAMPENER FOR LITHOGRAPHIC PRINTING PLATES

BACKGROUND OF INVENTION

Dampening systems of the type disclosed in U.S. Pat. No. 3,168,037 and U.S. Pat. No. 3,343,484 to Harold P. Dahlgren have offered significant improvements over dampening systems previously employed.

Such systems have included two rollers disposed in pressure indented relation, one of the rollers having a relatively hard hydrophilic surface and the other roller having a smooth resilient surface. In the preferred embodiment illustrated in the drawings of the aforementioned patents the transfer and metering rollers were geared together to travel at substantially equal surface speeds and were driven by a variable speed drive means for metering a film of dampening fluid through a nip between the rollers and for transferring the film of dampening fluid to the lithographic printing system.

The thickness of the film of dampening fluid delivered to the surface of the transfer roller moving out of the nip between the metering roller and transfer roller was controlled primarily by adjustment of pressure between adjacent surfaces of the metering and transfer rollers.

The rate of the metered film of dampening fluid, carried on the surface of the transfer roller and delivered to the lithographic printing system, was controlled by the variable speed drive means. Briefly stated, the theory of operation was that given a film of predetermined thickness the quantity of dampening fluid delivered was directly related to the speed of the film. In other words, to reduce the rate at which dampening fluid was delivered to the lithographic system, the transfer roller speed could be reduced; and, to increase the quantity of dampening fluid, the speed of the transfer roller could be increased. However, such results follow only so long as the speed differential between the transfer roller and the ink coated form roller was not excessive.

Excessive slippage resulted in application of hydraulic forces in the nip between the transfer roller and the applicator roller which caused excessive emulsification of the distinct films of ink and dampening fluid. Excessive emulsification of ink and dampening fluid at the nip between the transfer roller and form roller resulted in transfer of the emulsion by the surface of the transfer roller to the surface of the resilient metering roller which was not hydrophilic. Build-up of ink on the surface of the metering roller resulted in streaking of printed sheets because of non-uniform surface characteristics of the metering roller which caused a non-uniform film of dampening fluid to be metered onto the surface of the transfer roller.

To accommodate existing press design, metering and transfer rollers have been constructed of diameters generally in a range of approximately 3 to 6 inches. At surface speeds of about 300 feet per minute, films of dampening fluid tended to separate from the surface of the metering roller as a result of centrifugal force. When the metering roller, geared to the transfer roller, was slowed to prevent splashing and slinging of dampening fluid, excessive slippage resulted at the nip between the transfer roller and the form roller which carried the dampening fluid to the lithographic printing system.

In applications where the metering roll was geared to the hydrophilic transfer roller and where a relatively fast hydrophilic transfer roller surface speed was required for printing, such as in a web press, the metering roller slung water to such an extent that experiments were conducted on apparatus wherein the transfer roller and metering roller were geared together to run at a speed ratio of 2:1 thereby substantially reducing the surface speed of the metering roller which carried a thick film of dampening fluid. Slinging of dampening fluid was then stopped but the film of dampening fluid delivered by the transfer roller was of a thickness which required excessive slippage, resulting in excessive emulsification, between the hydrophilic transfer roller and the form roller.

SUMMARY OF INVENTION

I have developed an improved dampening system for lithographic printing plates comprising a transfer roller having a hard smooth hydrophilic surface disposed in pressure indented relation with an applicator roller having a smooth resilient ink coated surface wherein the transfer roller is driven by force transmitted through an interface between ink and dampening fluid.

A metering roller having a smooth resilient surface urged into pressure indented relation with the transfer roller, is preferably rotated such that the surface speed thereof will carry an abundant supply of dampening fluid to the nip between the transfer roller and the metering roller. The transfer roller, driven by force hydraulically transmitted thereto through the interface between ink and dampening fluid, is rotated such that the surface speed thereof is substantially greater than the surface speed of the metering roller for transferring a relatively thin film of dampening fluid to the surface of a form roller of a lithographic system.

The transfer roller preferably rotates such that the surface speed thereof is different from that of the form roller and adjusted such that a portion of the film of dampening fluid on the transfer roller will be applied to the surface of the form roller while sufficient dampening fluid remains upon the surface of the transfer roller moving away from contact with the form roller to maintain a continuous film of dampening fluid thereon for maintaining ink rejecting properties of the hydrophilic surface.

Pressure between the metering roller and the transfer roller is adjustable and pressure along the length thereof is controlled by skewing apparatus adapted to move an end of one of the rollers circumferentially about the axis of the other roller to spirally twist the resilient surface of the resilient roller about the harder surface of the other roller.

A primary object of the invention is to provide a dampening system for lithographic printing plates particularly adapted for continuously and automatically supplying precisely proportioned quantities of dampening fluid and ink to a lithographic system.

Another object of the invention is to provide a dampening system for lithographic printing plates adapted to precisely control hydraulic force at a nip between adjacent rollers for splitting a metered film carried by one of the rollers to cause a film to be transferred to the other roller.

Another object is to provide a dampening system for lithographic printing plates which is particularly adapted to prevent transfer of ink to a nip between transfer and metering rollers positioned in pressure ndented relation for metering a film of dampening luid.

These and other objects are effected by the invention is will be apparent in the following description taken in conjunction with the accompanying drawings.

DESCRIPTION OF THE DRAWINGS

Drawings of two embodiments of the invention are innexed hereto so that the invention may be better and nore fully understood, in which:

FIG. I is a diagrammatic perspective view of the lampener for lithographic printing plates;

Figure 1:
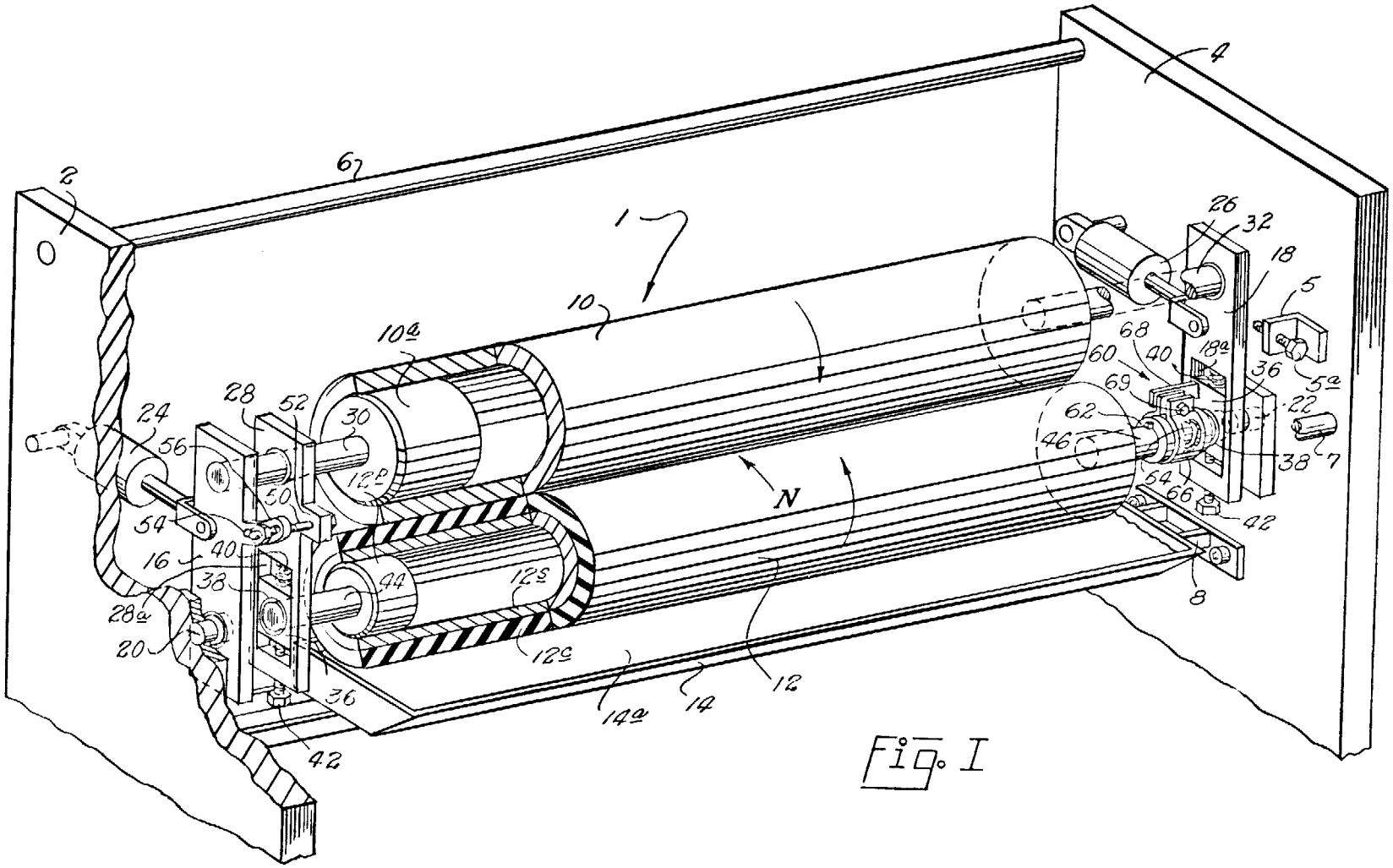

FIG. II is an enlarged diagrammatic view illustrating he relative positions of the source of dampening fluid, metering roller, a transfer roller, and a form roller in lithographic printing system; and FIG. III is a diagrammatic view, similar to FIG. II, of modified form of the dampener.

Numeral references are employed to designate parts of the apparatus illustrated in the drawing.

DESCRIPTION OF A PREFERRED EMBODIMENT

In FIG. I of the drawing the numeral 1 generally designates a liquid applicator system adapted for use in conjunction with inker apparatus for applying dampening fluid and ink to a lithographic printing plate of a printing press.

Liquid applicator 1 comprises spaced side frames 2 and 4 joined by tie bars 6, 7 and 8 forming a strong rigid structure for supporting transfer roller 10, metering roller 12 and dampening fluid pan 14.

Throw-off links 16 and 18 are pivotally secured by stub shafts 20 and 22 to the respective side frames 2 and 4. Throw-off cylinders 24 and 26 are pivotally connected between side frames 2 and 4 and throw-off links 16 and 18, respectively, for pivoting throw-off links 16 and 18 about stub shafts 20 and 22 for moving transfer cylinder 10 into position, as will be hereinafter more fully explained, for delivering dampening fluid to a lithographic printing system.

A skew arm 28 is mounted for pivotal movement about the axis of transfer roller 10. As diagrammatically illustrated in FIG. I skew arm 28 is rotatable secured to stub shaft 30 extending outwardly from the end of transfer roller 10.

Skew arm 28 and throw-off link 18 have passages **28*a* and 18*a* respectively, formed in lower ends thereof in which blocks 36 carrying self-aligning bearings 38 are slidably disposed. Suitable means such as resilient springs 40 urge blocks 36 longitudinally of skew arm 28 and throw-off link 18 in a direction away from the longitudinal axis of transfer roller 10. A pressure adjustment screw 42 urges block 36 longitudinally of skew arm 28 and throw-off link 18 against the bias of springs 40. Stub shafts 44 and 46, extending outwardly from opposite ends of metering roller 12, are received in self-aligning bearings 38 to rotatably secure metering roller 12 in pressuure indented relation with transfer roller 10.**

It should be readily apparent that rotation of pressure adjustment screws 42 will move opposite ends of metering roller 12 relative to the axis of transfer roller 10 for controlling pressure between transfer roller 10 and metering roller 12.

Suitable means is provided for establishing and maintaining a desired angular relationship between throw-off link 16 and skew arm 28. In the form of the invention illustrated in the drawing a lock bolt 50 extends through an aperture in lug 52 on skew arm 28 and is received in an arcuate slot 54, having a center of curvature coincident with the axis of transfer roller 10, formed in a lug 56 on throw-off link 16.

It should be readily apparent that bolt 50 can be loosened permitting rotation of skew arm 28 about the axis of transfer roller 10 and tightened to maintain a desired angular relationship between throw-off link 16 and skew arm 28.

Side frames 2 and 4 have suitable adjustable stop means such as angle members 5 having set screws **5*a* extending therethrough for engaging throw-off links 16 and 18 when rods of throw-off cylinders 24 and 26 are extended for establishing a desired pressure relationship between the transfer cylinder 10** and an ink coated form roller arranged to transfer dampening fluid to a lithographic printing plate as will be hereinafter more fully explained.

A friction brake assembly 60 is disposed about the shaft 46 of metering roller 12. The friction brake assembly 60 includes a brake drum 62 about which is disposed a brake lining 64 enclosed within a brake band 66, attached to throw-off link 18 by an attachment lug 68. The brake band 66 is secured about brake lining 64 by a bolt 69.

In the particular embodiment of the invention illustrated in FIG. I a portion of the surface of metering roller 12 is submerged in dampening fluid **14*a* in dampening fluid pan 14.**

The dampening fluid may be moistening fluid such as water with other ingredients added thereto, such as material to lower the surface tension of the water for reducing the tendency of the water to form globules on the surface of ink which would prevent uniform distribution of a film of dampening fluid over a film of ink.

Dampening fluid **14*a*** preferably comprises a mixture of water and water soluble, volatile organic liquid such as alcohol, esters, ketones, and similar compounds which are compatible with, and receptive to, oil-based ink. Commercial grade alcohol is preferably employed because of its economy and ready availability. Such material is molecularly compatible with ink because the vehicle of the ink is organic material and the dampening fluid containing alcohol is organic material.

Preferably a watery, highly volatile alcohol such as ethyl alcohol, methyl alcohol or isopropyl is used.

It has been found that mixing 5 to 1 water with alcohol works satisfactorily for most printing operations. Dampening fluid containing alcohol is quickly absorbed in the inking system because it is ink compatible and rides on the surface of ink coated form rollers in a uniformly thin layer and evaporates quickly. Upon evaporation alcohol does not cause oxidization as does water and provides a cooling agent for the rollers running in contact.

The transfer roller 10 is preferably metal and has an exterior surface which is highly machined and polished and treated so as to render same moisture receptive or hydrophilic. Preferably the surface of roller 10 is chrome plated, and is polished and treated after chrome plating, so as to render it hydrophilic, and at the same time make the surface perfectly smooth insofar as possible so that no irregularities or coarse areas thereof present a surface for the depositing of ink thereon by reason of the puncturing or breaking of the film or membrane of dampening fluid deposited thereon, as it rotates under pressure with a form roller, as will be hereinafter more fully explained. Peaks of irregularities, or coarse surface areas, puncturing and extending through a dampening fluid membrane, would contact ink on the surface of the form roller, causing transfer of ink back to the dampening system. The surface of roller 10 should be ground and polished to provide a surface smooth finish within a range of 0.5 to 50 RMS micro-inch. Best results have been obtained with a finish of 5 micro-inch.

It has been found that a chrome surface is readily susceptible to the formation of chrome oxide thereon when exposed to air during normal manufacturing processes, which prevents the surface from being water receptive or hydrophilic. Such chrome oxide also provides a hydrophobic or chemically greasy surface, which wouuld provide an attraction for ink. The treatment hereinafter described is for the purpose of removing chrome oxide from the surface of the transfer roller 14 and preventing same from reforming thereon after such treatment.

One method of treatment comprises bathing the chromium surface with a solution of one part hydrochloric or sulfuric acid, one part gum arabic water solution, 14° Baume, and one part water. The acid dissolves and removes the chromium oxide, and the gum arabic coats the surface of the chrome to prevent further oxidation. The period of time which the chromium surface must be exposed to this mixture depends upon the time between the chromium plating and machine processing of the surface, and the treatment. The longer the surface is exposed to the air the greater will be the accumulation of chromium oxide. It has been found that the surface of the roller 10 so treated will pick up a uniform film of moisture from the nip N between transfer roller 10 and metering roller 12 and such film of dampening fluid on roller 10 is rotated to contact the surface of the ink coating on the surface of form roller 90.

Transfer cylinder 10 preferably comprises a hollow tubular sleeve having plugs 10*a* in the ends thereof on which stub shafts 30 and 32 are formed. As hereinbefore explained, stub shaft 30 extends through bearings in skew arm 28 and throw-off link 16 and stub shaft 32 is rotatably journaled in a bearing in the upper end of throw-off link 18.

Metering roller 12 preferably comprises a hollow tubular sleeve 12*s* having plugs 12*p* extending into opposite ends thereof. Plugs 12*p* have stub shafts 44 and 46 formed thereon.

A resilient cover 12*c* is secured about the outer surface of sleeve 12*s*. The preferred process for forming resilient cover 12c is described in U.S. Pat. No. 3,514,312 to provide a roller comprising the metal substrate 12*s* having an adhesive bonded to it, a layer of relatively hard plastic bonded to the adhesive, and a layer of softer plastic fused to and co-mingled with the intermediate layer of harder plastic.

To reduce the tendency of dampening fluid to accumulate adjacent the ends of transfer roller 10, metering roller 12 is longer than transfer roller 10 such that ends of the metering roller 12 extend beyond the ends of transfer roller 10. The transfer roller 10 is preferably longer than form roller 90 to minimize accumulation of excess dampening fluid adjacent ends of form roller 90.

Referring to FIG. II of the drawing it should be noted that the transfer roller 10 could be positioned so that a portion of the surface thereof would be partially submerged and rotate in dampening fluid 14*a*, in which case the metering roller 12 would be positioned to rotate in contact with transfer roller 10 out of the dampening fluid, or in some applications the metering roller could be eliminated. If metering roller 12 were eliminated, a wick-like sponge would preferably be positioned in pan 14 such that dampening fluid 14*a* would be absorbed by the sponge and wiped onto the surface of transfer roller 10.

In the form of the invention illustrated in FIGS. I and II of the drawing, transfer roller 10 is rotated by frictional force transmitted through the interface adjacent surface 108 of ink film 100 and dampening fluid film 104.

Metering roller 12 is driven by force transmitted through dampening fluid film 103 separating surfaces of transfer roller 10 and metering roller 12.

From the foregoing it should be readily apparent that transfer roller 10 and the metering roller 12, in the embodiment illustrated in FIGS. I and II of the drawing, comprise idler rollers, or otherwise stated float relative to each other with regard to the mechanical structure; except that, friction brake 60 may be adjusted to assure that metering roller 12 runs at a surface speed which is substantially less than that of transfer roller 10.

At high press speeds (for example, wherein surface speeds of rollers exceed approximately 1000 ft. per minute) centrifugal force tends to separate thick films of fluid from roller surfaces. The surface speed of transfer roller 10 is preferably at least 50 percent of the surface speed of roller 90 to assure that an unbroken film 116 of dampening fluid remains on the surface of transfer roller 10 as it moves out of engagement with applicator roller 90. The unbroken film 116 of dampening fluid on the surface of transfer roller 10 assures that the hydrophilic surface will maintain its ink rejecting capability.

A modified form of the apparatus is illustrated in FIG. III of the drawing.

The apparatus illustrated in FIG. III is identical to that hereinbefore described and like numerals designate like parts, except as hereinafter noted.

Roller 12' is driven by a starter motor 79 connected through conductors 80 and 82 to a source of electricity. In the illustrated embodiment starter motor 79 is a reversible variable speed electric motor.

A primary function of starter motor 79 is to rotate metering roller 12 and transfer roller 10 through one or more complete revolutions prior to moving the surface of transfer roller 10 into engagement with ink film 100 on the surface of applicator roller 90. Such rotation of rollers 10 and 12 assures that a continuous unbroken film of dampening fluid extends about the surface of transfer roller 10 prior to throwing the dampener on impression. It will be appreciated that when starting the press after a prolonged cessation of operation, films 104 and 116 of dampening fluid on the surface of transfer roller 10 may evaporate permitting physical contact between film 100 of ink and the surface of transfer roller 10 unless the dampening fluid film is replenished.

Starter motor 79 is preferably de-energized after a continuous film of dampening fluid has been formed about the surface of transfer roller 10. However, under certain operating conditions, depending upon film thicknesses to be applied, molecular attractive forces between the dampening fluid and the surface of the metering roller 12, temperature and other factors encountered under specific operating conditions, it may be deemed expedient to employ motor 79 for controlling the speed of rotation of metering roller 12 in lieu of, or in addition to, control provided through brake 60.

It should be appreciated that while motor 79, in the illustrated embodiment, is independent of the press drive, power transmission apparatus driven by the press may be employed for rotating roller 12'.

Referring to FIG. II of the drawing, transfer roller 10 is preferably positioned in pressure indented relation with a form roller 90 having a metal tubular core 91, to the ends of which are secured stub shafts extending outwardly therefrom and rotatably journaled in bearings carried by links 92 pivotable about a shaft 94 rotatably secured to the side frames of a printing press and carrying an inker vibrator roller 98.

A connector 95 is pivotally secured to the links 92 and throw-off links 16 and 18 and is positioned such that the surface of roller 90 is separated from the surface of the printing plate 112 and from the surface of transfer roller 10 when the dampener is thrown off. Pressure at nip 106 is controlled by screw S.

Roller 90 has a smooth resilient outer cover 96 which is preferably non-absorbent.

Roller 98 is preferably a vibrator roller of conventional design and is adapted to apply a film of ink 100 to surfaces of form rollers 90 and 90*a*.

The operation and function of the apparatus hereinbefore described is as follows:

Pressure between ends of transfer roller 10 and metering roller 12 is adjusted by rotating pressure adjustment screws 42.

Since long rollers urged together in pressure relation tend to deflect or bend, pressure adjacent centers of such rollers is less than pressure adjacent ends thereof. Pressure longitudinally of rollers 10 and 12 is adjusted by loosening bolt 50 and rotating skew arm 28 about the axis of transfer roller 10 to a position wherein a desired pressure distribution longitudinally of rollers 10 and 12 is obtained.

Adjustment screw 5 is positioned to engage throw-off links 16 and 18 for establishing a desired pressure between transfer roller 10 and form roller 90.

For the purpose of graphically illustrating the novel function and results of the process of the mechanism hereinbefore illustrated and described, an enlarged, exaggerated, diagrammatic view of the metering roller 12, the transfer roller 10 and the form roller 90 is shown in FIG. II.

As shown in such exaggerated illustration, metering roller 12, which is preferably a resilient surfaced roller having a smooth surface 12*c* thereon, has the lower side thereof immersed in dampening fluid 14*a* in pan 14. The roller 12 is in rotative contact with transfer roller 10, and the pressure therebetween is adjusted as hereinbefore described, so that the surface of transfer roller 10 is actually impressed into the surface of roller 12 as indicated at nip N.

As roller 12 rotates toward the nip N between rollers 10 and 12, a relatively heavy layer of dampening fluid, indicated at 101, is picked up and lifted on the surface of roller 12, and at the point of tangency, or cusp area at the nip N, between the rollers 10 and 12, a bead 102 of dampening fluid is piled up, the greatness of which is regulated by virtue of the fact that excess dampening fluid will fall back into the pan 14 by gravity, thus virtually creating a waterfall. The bead 102 becomes a reservoir from which dampening fluid is drawn by transfer roller 10. As rollers 10 and 12 rotate in pressure indented relation, a relatively thin layer of dampening fluid is metered between adjacent surfaces of the two rollers, as indicated at 103. Since the transfer roller 10 is treated to provide a smooth, hydrophilic surface thereon, a portion of the film 103 adheres to the surface of roller 10 as indicated at 104, the remaining portion 105 thereof being rotated back to fluid 14a in the pan 14. The film of dampening fluid 104 is evenly distributed on the surface of roller 10 by reason of the rotating, squeezing action between rollers 10 and 12 at their tangent point at nip N.

The film of dampening fluid 104 rides on the surface of roller 10 and comes in contact with the film 100 of viscous ink on form roller 90 at the tangent point between said rollers, as indicated at 106.

At tangent point 106 it will be observed that transfer roller 10 is impressed into the resilient surface of form roller 90 and that the film of dampening fluid 104 has an outer face 108, contacting ink film 100 forming an interface therebetween, and an inner face 110 adhering to the surface of roller 10 and actually separates the surface of transfer roller 10 from the film of ink 100 on form roller 90, so that there is in fact a hydraulic connection between rollers 10 and 90 as they rotate in close relationship, but there is no physical contact therebetween. The film of ink 100 is actually separated from the smooth surface of roller 10 by the film of dampening fluid 104.

It is an important fact to note that the film of dampening fluid 104 serves as a lubricant and permits rollers 10 and 90 to be rotated at different surface speeds as will be hereinafter explained. Preferably, the form roller 90, which is normally rotated at the same surface speed as the lithographic printing plate 112, is rotated at a greater surface speed than the surface speed of roller 10. By adjusting pressure between rollers 10 and 90 and the thickness of film 104 thereby regulating the differential surface speed between transfer roller 10 and applicator roller 90, the amount of dampening fluid applied to the plate 112 may be regulated.

Within limits, as will be hereinafter more fully explained, if the surface speed of transfer roller 10 is increased the dampening fluid film 104 is presented at the tangent point 106 at a faster rate and more dampening fluid is transferred on the surface of ink film 100 to lithographic printing plate 112, and the opposite is true, if the surface speed of roller 10 is decreased.

The film of dampening fluid 104, existent between adjacent surfaces of rollers 10 and 90, permits rollers 10 and 90 to be rotated at different surface speeds in sliding relationship, because the film of dampening fluid 104 actually constitues a lubricant which permits slippage between adjacent surfaces of rollers 10 and 90 without frictional deterioration. By reason of the slippage between rollers 10 and 90, the dampening fluid film 104 is calendared, smoothed out, metered and distributed between adjacent surfaces of roller 10 and the ink film 100 on form roller 90, and the thickness and amount thereof is actually regulated by such means.

While some slippage between adjacent surfaces of transfer roller 10 and form roller 90 is desirable and contributes to effective operation of the apparatus, excessive slippage is detrimental. Transfer roller 10 preferably is driven at a surface speed which is within a range of for example, 500 feet per minute slower than the surface speed of form roller 90. For example, if a printing press has paper travelling therethrough at a surface speed of 1200 feet per minute the surface of the printing plate 112 and surfaces of form roller 90 will ordinarily have surface speeds of 1200 feet per minute. The surface speed of transfer roller 10 would preferably rotate at a surface speed in a range between 700 feet per minute and 1000 feet per minute.

Excessive slippage between adjacent surfaces of transfer roller 10 and form roller 90 increases hydraulic forces acting upon ink film 100 and dampening fluid 104 which is believed to result in emulsification of the ink and dampening fluid in the nip 106 resulting in transfer of ink to the nip N between transfer roller 10 and metering roller 12, which has a surface which is receptive to ink even in the presence of dampening fluid. Slippage between transfer roller 10 and metering roller 12 in the presence of ink causes the ink to be calendared into microscopic pores forming streaks on the metering roller surface. This causes irregularities in film 104 carried by transfer roller 10.

The allowable differential in surface speeds of transfer roller 10 and form roller 90 is dependent upon a number of conditions including the degree of attraction of the specific ink for dampening fluid, the thickness of the film of dampening fluid 104 carried by transfer roller 10 and atmospheric conditions including relativie humidity and temperature.

Provided the differential speed between surfaces of transfer rollers 10 and form roller 90 does not exceed permissible limits under given operating conditions, the film 104 of dampening fluid will split as rollers 10 and 90 rotate away from a tangent point therebetween in nip 106. A film of dampening fluid 114 adheres to the surface of the film 100 of more viscous ink carried by form roller 90 and a film 116 of dampening fluid adheres to the surface of the transfer roller 10 from whence it is conveyed back to the bead 102 of dampening fluid adjacent nip N.

It has already been explained that the dampening fluid film 104 is smoothed out, distributed, metered, and regulated between the tangent points of rollers 10 and 90. The interface tension between the outer surface 108 of the less viscous dampening fluid film 104, by reason of molecular attraction between the face of the more viscous ink film 100, causes the smoothened and regulated film 104 to cling to the surface of ink 100, which in turn is transferred to the plate at the tangent point between the plate 112 and form roller 90, as indicated at 120. Controlled molecular amalgamation of ink and dampening fluid at the interface between films 100 and 114 is accomplished by adjustment of pressure at nip N and nip 106.

The lithographic printing plate 112 has hydrophilic, or water liking, non-image areas 121 and oleophilic, or ink receptive, images areas 122 formed on the surface thereof.

At the nip 120 between applicator roller 90 and printing plate 112, the ink film 100 is split, forming films 125 of ink over oleophilic surfaces 122 on the printing plate. The layer 114 of dampening fluid carried on film 100 of ink is distributed to form a thin film 126 of dampening fluid over hydrophilic areas 121 of the printing plate and over ink 125 thereon.

A thin film of excess dampening fluid remains on the surface of form roller 90 which is moving away from the nip 120, but such dampening fluid as remains thereon is transferred on the ink film 128 to the ink film 130 on the ink vibrator roller 94 where the dampening fluid is dissipated and absorbed, to such an extent as to be of no consequence in the inking system. A thin film 100' of dampening fluid is returned to and through nip N.

From the foregoing it should be readily apparent that the improved apparatus for dampening lithographic printing plates offers control of metering at nip N to provide a film 104 of dampening fluid of precisely controlled thickness by adjusting pressure between transfer roller 10 and metering roller 12 and further by controlling surface speeds of the rollers relative to each other. The rate at which the metered film 104 of dampening fluid is offered to film 100 of ink, and also the hydraulic force for obtaining the desired film split while eliminating conditions which cause feedback of excessive quantities of ink with dampening fluid film 116 on transfer roller 10 moving away from the nip 106 is accomplished automatically by the improved structure.

Since the thickness of film 104 of dampening fluid controls lubrication and consequently force transmitted to rotate transfer roller 10, it should be appreciated that dampening fluid delivered to applicator roller 90 is self-regulated by demand.

While a preferred embodiment of the invention has been hereinbefore described and illustrated in the attached drawings it should be appreciated that other and further forms of the apparatus can be devised without departing from the basic concept thereof.

Having described my invention, I claim:

1. Apparatus for applying dampening fluid over a roller having an ink-coated liquid receptive surface to a printing plate in a lithographic printing system, said ink-coated liquid receptive surface moving at a surface speed substantially equal to the surface speed of the printing plate, comprising: a dampening fluid transfer roller having a hydrophilic surface thereon; a metering roller having a smooth, resilient surface thereon; means to support the metering and transfer rollers in pressure indented surface relation to form a metering nip; support means arranged to urge a film of dampening fluid on the transfer roller into pressure relation with the ink-coated liquid receptive surface to form an interface between the ink and the dampening fluid; means to apply an abundant supply of dampening fluid to the surface of said metering roller; means to rotate said metering roller at a surface speed to maintain an abundant supply of dampening fluid adjacent said metering nip, said means to rotate said metering roller being adapted to rotate said metering roller at a surface speed substantially less than the surface speed of the ink-coated liquid receptive surface, said means to apply an abundant supply of dampening fluid to the surface of said metering roller being adapted to prevent application of an abundant supply of dampening fluid to the surface of the transfer roller except adjacent said metering nip, said transfer roller being driven by said ink-coated liquid receptive surface by frictional force transferred through said interface.

2. The combination called for in claim 1 with the addition of means to vary pressure between adjacent surfaces of the metering roller and the transfer roller.

3. The combination called for in claim 1 wherein the means to rotate the metering roller comprises: variable speed drive means; and means driveably connecting said variable speed drive means to said metering roller.

4. The combination called for in claim 1 wherein the means to rotate the metering roller comprises: independent drive means.

5. The combination called for in claim 1 with the addition of means to vary pressure between adjacent surfaces of the transfer roller and the ink-coated liquid receptive surface.

6. The combination called for in claim 1 with the addition of a skew arm having an end of the metering roller and an end of the transfer roller rotatably mounted therein; means to move an end of at least one of the rollers longitudinally of the skew arm to establish and maintain a predetermined pressure adjacent ends of the transfer and metering rollers, said skew arm being rotatable about an axis of one of said rollers to adjust and control pressure intermediate the ends of said metering and transfer rollers.

7. In a device for dampening the plate in a lithographic printing press: a dampening fluid transfer roller having a smoothly finished hard surface thereon; a dampening fluid metering roller having a smooth resilient surface thereon; means supporting said metering roller and said transfer roller in pressure indented relation to form a first metering nip; a pan; means supporting said pan such that the surface of said metering roller is partially submerged in dampening fluid in said pan; an applicator roller having a smooth resilient surface; means supporting said applicator roller and transfer roller in pressure indented relation to form a second metering nip, said applicator roller being in rotative contact with the plate and driven at a surface speed substantially equal to the surface speed of the plate; means to vary pressure between said metering roller and said transfer roller at said first metering nip; means to vary pressure between said transfer roller and said applicator roller at said second metering nip; drive means to rotate said metering roller at a surface speed substantially less than the surface speed of said applicator roller, said drive means being adapted to rotate said metering roller at a surface speed to maintain an abundant supply of dampening fluid adjacent said first metering nip such that driving force exerted upon said transfer roller through a film of dampening fluid at said second metering nip is controllable by varying pressure at said first metering nip to control the thickness of the film of dampening fluid delivered to the second metering nip.

8. The combination called for in claim 7 wherein said drive means comprise a variable speed motor.

9. In a device for dampening the plate in a lithographic printing press: a dampening fluid transfer roller having a smoothly finished hard surface thereon; a dampening fluid metering roller having a smooth resilient surface thereon; means supporting said metering roller and said transfer roller in pressure indented relation to form a first metering nip; an applicator roller having a smooth resilient surface; means supporting said applicator roller and transfer roller in pressure indented relation to form a second metering nip, said applicator roller being in rotative contact with the plate and driven at a surface speed substantially equal to the surface speed of the plate; means to apply dampening fluid to the surfaces of said metering roller and said transfer roller adjacent said first metering nip, means to vary pressure between said metering roller and said transfer roller at said first metering nip; and means to vary pressure between said transfer roller and said applicator roller at said second metering nip, said transfer roller being driven by force transmitted through a film of dampening fluid at said second metering nip, said metering roller being driven by force transmitted through a film of dampening fluid at said first fluid metering nip wherein the surface speed of the metering and transfer rollers are controllable by varying pressure at said first and second metering nips.

10. The combination called for in claim 9 with the addition of: a brake operably connected to said metering roller.

* * * * *